US012059601B2

(12) United States Patent
Juckelandt et al.

(10) Patent No.: US 12,059,601 B2
(45) Date of Patent: Aug. 13, 2024

(54) INFLATABLE BALL

(71) Applicant: adidas AG, Herzogenaurach (DE)

(72) Inventors: Christoph Juckelandt, Fuerth (DE); Stefan Alois Bichler, Osterhofen (DE); Franziska Maria Eva Löffelmann, Behringersdorf (DE); Ullrich Nadrau, Weisendorf (DE); Henry Hanson, Herzogenaurach (DE); Matthew Ward, Loughborough (GB)

(73) Assignee: adidas AG, Herzogenaurach (DE)

( * ) Notice: Subject to any disclaimer, the term of this patent is extended or adjusted under 35 U.S.C. 154(b) by 56 days.

(21) Appl. No.: 17/698,408

(22) Filed: Mar. 18, 2022

(65) Prior Publication Data

US 2022/0296969 A1 Sep. 22, 2022

(30) Foreign Application Priority Data

Mar. 19, 2021 (DE) ..... 102021202706.7
Mar. 16, 2022 (EP) ..... 22162392

(51) Int. Cl.
*A63B 41/08* (2006.01)

(52) U.S. Cl.
CPC ..... *A63B 41/08* (2013.01); *A63B 2209/00* (2013.01); *A63B 2243/0025* (2013.01)

(58) Field of Classification Search
CPC ..... A63B 41/08; A63B 43/00; A63B 43/002; A63B 2209/00; A63B 2243/0025; A63B 2225/01
See application file for complete search history.

(56) References Cited

U.S. PATENT DOCUMENTS 2,931,653 A * 4/1960 Gow ..... A63B 41/08 473/596
4,000,894 A * 1/1977 Butzen ..... A63B 41/08 473/596
4,318,544 A 3/1982 Brine, Jr.
4,570,931 A * 2/1986 Martin ..... A63B 39/06 473/596
4,991,842 A * 2/1991 Finley ..... A63B 41/08 D5/53
5,354,053 A * 10/1994 Ratner ..... B29C 59/02 40/327

(Continued)

FOREIGN PATENT DOCUMENTS

BE 1016110 3/2006
BE 1016122 3/2006

(Continued)

OTHER PUBLICATIONS

European Patent Application No. 22162392.9, Extended European Search Report, Aug. 8, 2022, 8 pages.

(Continued)

*Primary Examiner* — Steven B Wong
(74) *Attorney, Agent, or Firm* — Kilpatrick Townsend & Stockton LLP

(57) ABSTRACT

An inflatable ball (such as a soccer ball) may have an outer shell comprising panels. The panels may include at least one surface texture. At least a subset of the panels may include indentations in addition to the surface texture. The indentations may include a shape which is different from a shape of the surface texture.

17 Claims, 10 Drawing Sheets

(56) References Cited

U.S. PATENT DOCUMENTS

| | | | | |
|---|---|---|---|---|
| 5,427,372 | A * | 6/1995 | Ratner | B29D 22/02 264/293 |
| 5,518,234 | A | 5/1996 | Palmquist | |
| 5,984,812 | A | 11/1999 | Sassak | |
| 6,283,881 | B1 * | 9/2001 | Feeney | A63B 43/00 473/596 |
| 7,585,236 | B2 * | 9/2009 | Krysiak | A63B 41/08 473/597 |
| 8,617,011 | B2 | 12/2013 | Berggren et al. | |
| 11,097,164 | B2 * | 8/2021 | Krysiak | A63B 41/02 |
| 2004/0142780 | A1 | 7/2004 | Estefano | |
| 2004/0185245 | A1 * | 9/2004 | Akamata | D06N 3/14 428/323 |
| 2007/0117662 | A1 | 5/2007 | Ma | |
| 2010/0255940 | A1 * | 10/2010 | Nuernberg | A63B 41/08 473/604 |
| 2015/0174458 | A1 * | 6/2015 | Tompkins | A63B 41/08 473/613 |
| 2017/0291076 | A1 | 10/2017 | Campbell | |
| 2018/0133562 | A1 | 5/2018 | Berggren et al. | |
| 2018/0339202 | A1 | 11/2018 | Molinari | |
| 2020/0230468 | A1 | 7/2020 | Molinari et al. | |
| 2021/0346767 | A1 * | 11/2021 | Campbell | A63B 43/00 |

FOREIGN PATENT DOCUMENTS

| | | | |
|---|---|---|---|
| CN | 2287982 | Y | 8/1998 |
| CN | 105459423 | A | 4/2016 |
| CN | 108635779 | A | 10/2018 |
| DE | 3703225 | A1 | 8/1988 |
| JP | 2010-240427 | A | 10/2010 |
| JP | 6564735 | B2 | 8/2019 |
| JP | 2020-520733 | A | 7/2020 |

OTHER PUBLICATIONS

German Patent Application No. 102021202706.7, Office Action mailed Nov. 29, 2021, 10 pages (English machine translation provided).

Hong et al., "Effect of a soccer ball's surface texture on its aerodynamics and trajectories", Proc IMechE Part P: J Sports Engineering and Technology, 2018, 8 pages.

Rogers , "A study of the relationship between surface features and the in-flight performance of footballs", Doctoral Thesis, Loughborough University, 2011, 250 pages.

Ward et al., "Comparing the Aerodynamic Behaviour of Real Footballs to a Smooth Sphere Using Tomographic PIV", MDPI Proceedings, 49, 150, 2020, 7 pages.

Office Action, Japanese Patent Application No. 2022-045547, Nov. 28, 2023, 10 pages.

Office Action, Chinese Patent Application No. 202210275940.6, Jul. 13, 2023, 13 pages.

Office Action, Japanese Patent Application No. 2022-045547, Jun. 20, 2023, 12 pages.

* cited by examiner

INFLATABLE BALL

CROSS REFERENCE TO RELATED APPLICATIONS

This application is related to and claims priority benefits from German Patent Application No. 102021202706.7, filed Mar. 19, 2021 ("the '706 application"), and European Patent Application No. 22162392.9, filed Mar. 16, 2022 ("the '392 application"). Both applications are hereby incorporated herein in their entirety by this reference.

FIELD OF THE INVENTION

Various embodiments herein relate to an inflatable ball (such as a soccer ball) having an outer shell comprising panels.

BACKGROUND

High quality balls generally comprise an outer shell which is composed of a multitude of prefabricated panels. A panel is in the following understood as being a separately prefabricated portion which forms less than a half of the ball shell.

The panels may be suitably attached relative to each other, for example by sewing of their edges or by gluing to the surface of the carcass. A direct gluing (or laser) welding of the edges of the panels to each other is also possible. For the sake of simplicity, the region where two adjacent panels contact each other, is simply called a "seam" in the following description, regardless of whether the panels are actually sewn to each other in a standard manner or whether they are fixed relative to each other in another way for providing the outer shell of the ball.

In the past, the shell of soccer balls consisted typically of 32 panels having pentagonal and hexagonal shapes, respectively. Based on the high number of small panels, a high percentage of time for ball manufacture was incurred for sewing, which is a labor-intensive step of the manufacturing process, often made by hand to provide a high-quality ball. However, it also has been realized that balls having large panels can have negative flight properties and can, for example, lead to instability. Nevertheless, the trend clearly goes to less and bigger panels. But due to aerodynamic effects there may be unintended and unpredictable flutter movements of a ball with bigger, smooth surface panels. It is immediately apparent that such aerodynamic effects essentially impair a controlled play and precise shots. Moreover, a smooth surface of the panels also reduces a level of control over the ball at the shoe, e.g. by a soccer player during dribbling. Similar problems also occur for inflatable balls for other sports, such as handball, volleyball, etc.

Several attempts have been made in the past to improve the aerodynamic properties of balls. For example, prior art document U.S. Pat. No. 4,318,544 discloses a soccer ball having an outer shell with a plurality of indentations arranged so as to provide a wind channel configuration which aids in aerodynamic control of the ball. Prior art document BE 1,016,122 relates to a football which has panels with recessed regions in form of holes, embossed areas or grooves. Further, prior art documents US 2020/0230468 A1 and U.S. Pat. No. 8,617,011 B2 show large elongated rib-like indentations. The plurality of indentations may include a plurality of peripheral channels or seams and a plurality of interior channels.

Furthermore, prior art document US 2004/0142780 A1 discloses sports balls provided with an external pattern applied all over their outer surface, said pattern being composed by a plurality of cavities equally spaced apart and of identical dimensions. Similarly, prior art document US 2007/0117662 A1 relates to a soccer ball, with a plurality of air-turbulence-producing depressions distributed over a majority of the outer surface of the skin.

Further prior art may be found in: Hong Sungchan et al., Effect of a soccer ball's surface texture on its aerodynamics and trajectories, 2018; Rogers David, A study of the relationship between surface features and the in-flight performance of footballs, UK 2011; Ward Matthew et al., Comparing the aerodynamic behavior of real footballs to a smooth sphere using tomographic PIV, 2020; BE 1,016,110 A6; BE 1,016,122 A6; U.S. Pat. No. 8,617,011 B2; and US 2020/0230468 A1.

While these existing constructions all try to have an influence on the flight properties or a ball control in general, they either lead to a ball with a heavily increased swerve or to trajectories with minimal swerve. Moreover, the parallel grooves also have an influence on an aimed shot, based on whether the shoe of the player directly hits such grooves or a smoother region of the shell. So far, the ideal balance has not been found.

Therefore, as described further herein, it may be beneficial to provide a ball, in particular a soccer ball, having good properties including an improved level of control at the shoe but also a balanced magnus effect in the air leading to a controlled degree of swerve which reduces the so called fluttering. Such a ball allows a more precise play so that the above outlined disadvantages of the prior art are at least partly overcome.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some embodiments, an inflatable ball is provided. The inflatable ball may include an outer shell. The outer shell may include panels. The panels may include at least one surface texture. At least a subset of the panels may include indentations in addition to the surface texture. The indentations may include a shape which is different from a shape of the surface texture.

In some embodiments, the inflatable ball may include a soccer ball.

In some embodiments, only the subset of the panels may include the indentations in addition to the surface texture, or all of the panels may include the indentations in addition to the surface texture.

In some embodiments, the indentations are polygonal. The indentations may be essentially kite-shaped, essentially elliptical, or essentially circular.

In some embodiments, the indentations are not in contact with panel edges. Additionally or alternatively, the indentations may be essentially placed within a central region of a panel.

In some embodiments, the indentations are distributed in-homogeneously on each panel having indentations.

In some embodiments, the indentations are distributed homogeneously on each panel having indentations.

In some embodiments, each panel may include only one surface texture. The surface texture may be essentially uniformly distributed on each of the panels, and/or a shape of the surface texture may be the same on each panel.

In some embodiments, at least some panels may include more than one surface texture.

In some embodiments, the surface texture may include multiple different shapes which are grouped relative to each other in a formation. A plurality of formations may be distributed at least partly across the panels, such that a distribution of the different shapes is repeatedly the same within the plurality of formations.

In some embodiments, a maximum extent of the at least one surface texture perpendicular to a surface of the inflatable ball is smaller than a maximum depth of the indentations.

In some embodiments, each panel having indentations may include at least two distinct indentation depths, indentation lengths, indentation widths, or a combination thereof. Additionally or alternatively, on each panel having indentations an indentation depth, indentation length, indentation width, or a combination thereof decreases on average in a direction from an inner region to an outer/edge region of the panel.

In some embodiments, at least one of: an indentation length varies between 1.0 and 30.0 mm; an indentation depth varies between 0 and 10 mm; or an indentation width varies between 0.1 and 15.0 mm.

In some embodiments, each panel may include an outer layer that may include polyurethane, and/or each panel may include an inner layer that may include a foamed material. At least some indentations may extend partly into a top surface of the inner layer and/or the at least one surface texture may extend only in the outer layer.

In some embodiments, the subset may include less than 32 panels, and/or the number of panels not within the subset is less than 24 panels.

In some embodiments, a maximum extent of the at least one surface texture perpendicular to a surface of the inflatable ball is less than 1.5 mm. Additionally or alternatively, a shape of at least one surface texture is polygonal. A maximum length of a side of the polygonal surface texture may be less than 20 mm.

In some embodiments, an overall roughness volume of the surface of the inflatable ball ranges between 7000 and 30000 $mm^3$.

BRIEF DESCRIPTION OF THE DRAWINGS

In the following detailed description, embodiments of the invention are described referring to the following figures.

BRIEF DESCRIPTION

Figure 1A:
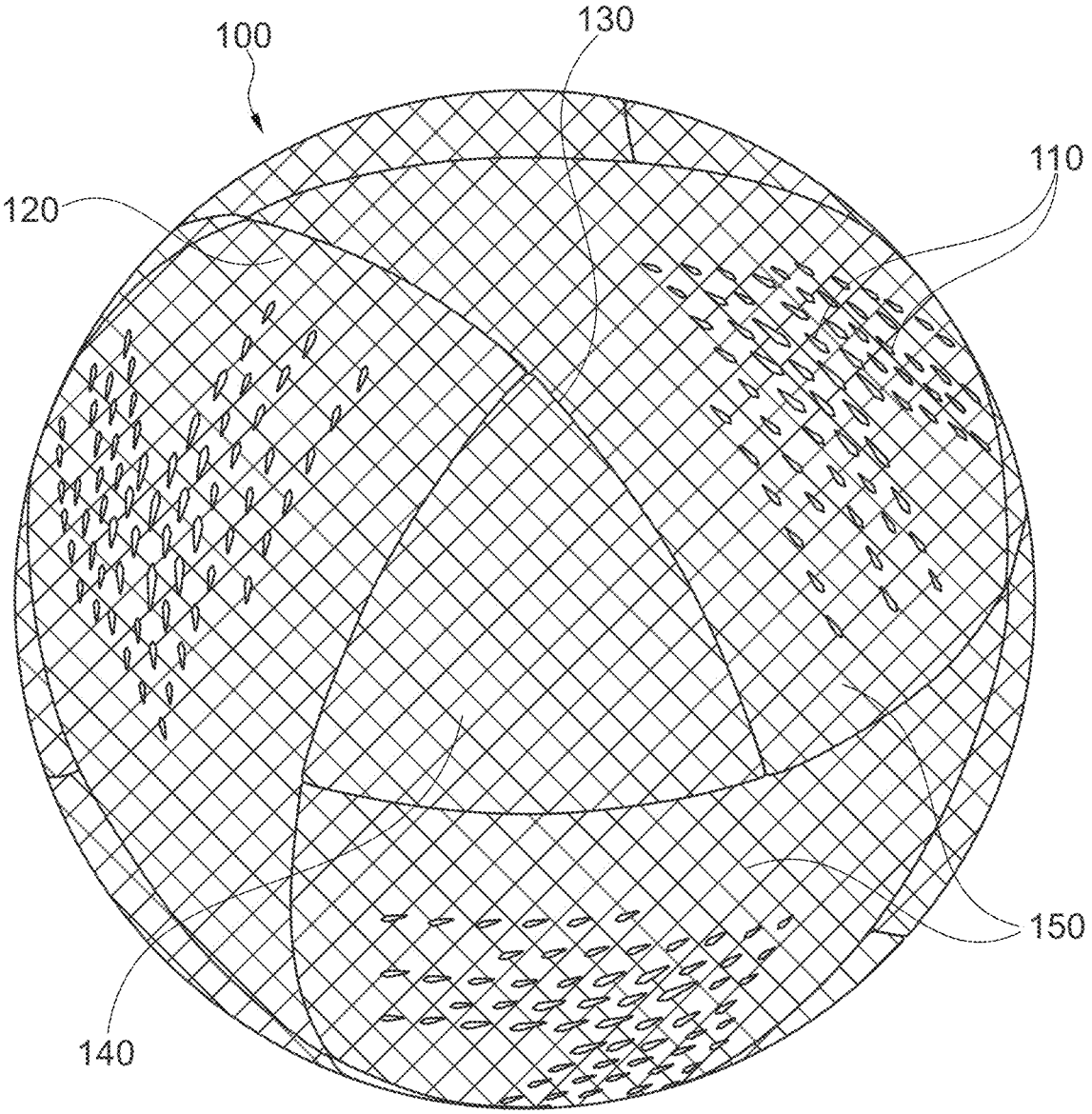
FIGS. 1*a*, 1*b*, and 1*c* show three different points of view of a ball with kite-shaped indentations, in accordance with various embodiments.

In some embodiments, an inflatable ball (such as a soccer ball) is provided having an outer shell comprising panels. The panels comprise at least one surface texture, wherein at least a subset of the panels comprises indentations in addition to the surface texture. The indentations further comprise a shape which is different from a shape of the surface texture.

In general, a moving object, such as a ball flying through the air, has a high-pressure area on its front side compared to its back side. Air flows smoothly over the contours of the front side and eventually separates from the ball toward the back side. A flying ball also leaves behind a turbulent wake region where the air flow is fluctuating or agitated, resulting in lower pressure behind it. The size of the wake affects the amount of drag on the object. At least one surface texture(s) on the outer shell of the ball create(s) a thin turbulent boundary layer of air that clings to the ball's surface. This allows the smoothly flowing air to follow the ball's surface a little farther around the back side of the ball, thereby decreasing the size of the wake. Thus, the at least one surface texture provides a reduced drag of the ball compared to a ball with a smooth surface, which can result in longer shots.

Despite the potential of longer shots based on the surface texture(s) of the panels, the inventors found that additionally incorporating indentations on at least a subset of panels can greatly improve the accuracy of the ball flying. For example, a prediction of a trajectory of the ball is greatly improved, which is highly relevant for all players on the field including the goal keepers. However, spectators live and on television may also follow the game more easily, leading to a more compelling and pleasant experience. Even a shooter himself or herself can more reliably trust the flight behavior of the ball, enabling more accurate shots. Additionally, an unintended fluttering of the ball may be reduced by the indentations. Thus, for example the difficult decision of a player to go for a high risk and long-range shot will be facilitated making a game more spectacular by the inflatable ball herein.

Furthermore, not only may the flight behavior be enhanced, but the at least one surface texture of the panels may also provide an inflatable ball having an improved level of control at the shoe, allowing for a more enhanced dribbling with the ball.

In some embodiments, only the subset of the panels may comprise indentations in addition to the surface texture. In this manner, the flight behavior of the inflatable ball may be precisely optimized by carefully selecting the number of panels of the subset. Moreover, carefully arranging the panels of the subset on the outer shell of the inflatable ball enables a further tuning of the flight behavior, in particular the predictability of the flight behavior, of the inflatable ball.

Alternatively, all panels may comprise indentations in addition to the surface texture. A higher number of panels having indentations may increase the magnus effect of the ball in the air. This leads to an increased swerve of the inflatable ball.

The surface texture and the indentations may be arranged independently from each other on the panels. Thus, a pattern of the surface texture may not be interrupted or significantly changed at the indentations. In this manner, the surface texture may be present in the indentations and vice versa.

The indentations may be polygonal, in particular essentially kite-shaped, diamond-shaped, or even square-shaped. Additionally or alternatively, elliptical, in particular essentially circular indentations, may also be applicable. The inventors found that the shape of the indentations has an influence on the flight behavior of the inflatable ball. Both kind of shapes of indentations, polygonal or elliptical, improve a predictability of a trajectory of a ball. The inventors further found that polygonal shaped indentations provide a slightly higher level of predictability. On the other hand, elliptically shaped indentations enable a slightly higher speed of a ball. The term "essentially" as used herein is to be understood as also including small deviations in the range of 5 to 10%. The deviations can, for example, be based on material properties, and/or manufacturing uncertainties which are well known by a person skilled in the art.

The indentations may be not in contact with panel edges and/or may be essentially placed within a central region of the panel. For example, the indentations may have a minimal distance of at least 10 mm (or in some embodiments 15 mm), to the panel edges. In this manner, the indentations do not interfere with or negatively affect a seam between two panels. Moreover, while seams of the outer shell of the inflatable ball in general are positioned in slight depressions compared to the central region of the panel, the indentations placed within that central region of the panel can influence the flight behavior of the ball more significantly.

The indentations may be distributed in-homogeneously on each panel having indentations. The term "in-homogeneously distributed" as used herein may be understood in that each panel may comprise regions with a higher amount of indentations and regions with less or even no indentations. An in-homogenous distribution of indentations can also be defined based on an average spacing between adjacent indentations. Thus, an average spacing between adjacent indentations may be different in a first subset than in a second subset. In this manner, a density of the indentations may be varied across the panel. The term density as used in the present application refers to a number of indentations per surface area unit. An in-homogenous distribution of indentations can provide an inflatable ball with an optimized flight behavior. The distribution of indentations may further be individually adapted to a preferred flight behavior.

In some embodiments, the indentations may be homogeneously distributed on each panel having indentations. In a homogenous distribution an average distance between adjacent indentations may be essentially constant. It may be noted that a deviation in the average distance in the order of 5% between indentations on the same panel may still be referred to as a homogenous distribution. Indentations having an elliptical shape may be distributed homogeneously on each panel of the subset. However, a homogenous distribution of polygonal-shaped indentations may also applicable.

In some embodiments, each panel may comprise only one surface texture. The surface texture may be essentially uniformly distributed on each of the panels. The shape of the surface texture may vary across various panels, in particular each panel can have a different surface texture. In this manner, a precise selection of various surface textures and/or arrangements of different surface textures across various panels can provide a high degree of customization of the inflatable ball to a preferred flight behavior.

The surface texture may comprise multiple different shapes. The different shapes may be grouped relative to each other, building a formation. A plurality of formations may be distributed at least partly across the panel(s), such that a distribution of the different shapes may be repeatedly the same within the plurality of formations.

A shape of the surface texture may be the same on each panel. Thus, the level of control over the ball at the shoe may be nearly identical independent of a location of a contacting area on the outer shell. Each panel of the inflatable ball may comprise the surface texture.

Alternatively, at least some panels may comprise more than one surface texture. The at least two surface textures on the same panel may be at least partly overlapping or be arranged next to each other. Different surface textures on the same panel may provide a more specific adaptation of the surface of the inflatable ball regarding the flight behavior, the control at the shoe, and other properties.

A maximum extent of the at least one surface texture perpendicular to a surface of the inflatable ball may be smaller than a maximum depth of the indentations. As described above, the at least one surface texture, in particular if essentially uniformly distributed on each of the panels, can lead to a thin turbulent boundary layer of air that clings to the ball's surface. The larger depth of the indentations can than intentionally disturb the thin boundary layer of air at the panels having indentations, creating the ability to influence the flight behavior of the ball. Thus, depending on the depth of the indentations, a higher stability of the ball in the air may be created.

Each panel having indentations may comprise at least two (or at least three or at least four) distinct indentation depths, indentation lengths, indentation widths, or a combination thereof. In some embodiments, on each panel having indentations an indentation depth, indentation length, indentation width, or a combination thereof may decrease on average in a direction from an inner region to an outer/edge region of the panel. It may be noted that the term "decrease on average in a direction from an inner region to an outer/edge region" may generally allow for neighboring indentations having the same but not increasing size in the defined direction. Carefully varying the parameters of each indentation or a group of indentations on a panel may be used to positively influence the flight behavior of the inflatable ball. Optimized parameters can, for example, be found by standardized experiments (in a lab, a wind channel, etc.) or calculated using a theoretical model.

An indentation length may vary between 1.0 and 30.0 mm, between 1.5 and 20.0 mm, or between 2.0 and 10.0 mm. The term length as used herein relates to the extent of the indentation between two points, wherein the greater of two dimensions parallel to the surface of the inflatable ball corresponds to the length. For example, for a (convex) kite-shaped indentation, the length corresponds to the extent along the line of symmetry. For a circular indentation, the length corresponds to the diameter, and for an elliptical shape, the length corresponds to twice the semi-major axis. An indentation depth may vary between 0 and 10 mm, between 0 and 8 mm, or between 0 and 6 mm. An indentation width may vary between 0.1 and 15.0 mm, 0.2 and 7.5 mm, or between 0.4 and 2.5 mm. Like the definition of the length, the width corresponds to the smaller extent of two dimensions along the surface. For example, for kite-shaped indentations, the width corresponds to the maximum extension between two corners perpendicular to the main direction of extension. For an elliptical shape, the width corresponds to twice the semi-minor axis. The inventors found that the listed ranges provide indentations not too small to show no influence on the flight behavior. But also, not to large/deep to introduce different responses on the shoe depending on contacting area being on a panel of the subgroup or not.

A flight behavior, in particular a predictability of the flight behavior, of the inflatable ball may depend on one of: a position of the indentations on the panel, a shape of the indentations, a depth of the indentations, a distance of the indentations to each other, or a combination thereof. In some embodiments, a shortest distance between two neighboring indentations on the same panel may be between 0.5 and 45.0 mm, between 1.0 and 30.0 mm, or between 1.5 and 15.0 mm. In this manner, the indentations optimally cooperate to beneficially affect the flight behavior, particularly the predictability of the flight behavior.

Each panel may comprise an outer layer comprising polyurethane (PU). Each panel may comprise an inner layer comprising a foamed material. In some embodiments, the inner layer may include ethylene propylene diene monomer (EPDM). In some embodiments, at least some indentations on each panel having indentations may extend partly into a top surface of the inner layer. The at least one surface texture may extend only in the outer layer.

The inflatable ball may further comprise a carcass. The carcass covers the surface of an inner bladder. The inner bladder provides for suitable airtightness of the ball and the carcass stabilizes the bladder and protects it against external shocks. The carcass further provides a constricting force towards the inner bladder.

In some embodiments, the panels and the carcass may be at least partly spray-coated with a glue, in some embodiments comprising latex. Panel edges of neighboring panels may be connected to each other via thermo activated bonding.

The indentations may be applied after a panel forming process. The panel forming process corresponds to a process in which the inner layer and the outer layer of each panel are attached to each other. No changes on typical machines for panel productions are incurred for manufacturing the inflatable ball, thereby improving a cost efficiency of the manufacturing process. Further, reusing already existing machinery reduces the overall carbon footprint of the manufacturing process. In some embodiments, the indentations may be created by pressing a plate having protrusions onto at least one panel.

The subset may comprise less than 32 panels, or less than 24 panels, or 12 panels. The number of panels not within the subset may be less than 24 panels, less than 16 panels, or 8 panels. As noted above, less and bigger panels reduce the amount of sewing incurred during manufacture, making the inflatable ball more cost-efficient.

A maximum extent of the at least one surface texture perpendicular to a surface of the inflatable ball may be less than 1.5 mm, less than 1.0 mm, or less than 0.5 mm. A shape of the at least one surface texture may be polygonal, in some embodiments tetragonal. A maximum length of a side of the polygonal surface texture may be less than 20 mm, less than 15 mm, or less than 10 mm.

An overall roughness volume of the surface of the inflatable ball may range between 7000 and 30000 $mm^3$, between 14000 and 25000 $mm^3$, or between 18000 and 22000 $mm^3$. The overall roughness volume may be best described starting from a base sphere. The base sphere corresponds to a smallest possible sphere encompassing an (idealized) inflatable ball having smooth panels, i.e., in particular no surface texture and no indentations. The overall roughness volume then corresponds to an absolute value of a volume difference between the base sphere and a volume of the inflatable ball defined by its surface. It may be noted that the overall roughness volume can comprise a first volume, which is inside the base sphere, for example the volume difference based on the seams, the indentations, and/or dented surface texture(s) of the inflatable ball. The overall roughness volume can further comprise a second volume, which is outside the base sphere, for example the volume difference based on at least one protruding surface texture(s). In these embodiments, the overall roughness volume corresponds to the sum of the absolute values of the first and second volume. Alternatively, the overall surface texture may consist only of the first volume, in particular for dented surface texture(s). Thus, the overall roughness volume depends at least on the indentations, the surface texture(s), and/or the seams. The inventors found that for a ball having an overall roughness volume within the defined range, the critical Reynolds number of the ball when flying through air may be shifted towards lower velocities, at which the flight behavior of the ball essentially does not depend on its drag. As a result, at higher velocities at which the drag is relevant for the ball's flight behavior, an essentially constant drag across various velocities may be accomplished. In this manner, a prediction of a trajectory of the ball may be greatly improved. Additionally, unintended fluttering of the ball may be reduced.

For example, when developing a new inflatable ball, a roughness volume of the seams may be determined first. Then, a plurality of indentations and/or at least one surface texture matching the suitable amount of roughness volume may be added to result at an overall roughness volume in the beneficially defined above ranges. The indentations and/or the at least one surface texture in some embodiments corresponds to the indentations and surface texture(s) as described herein.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments are described in more detail, with reference to an inflatable ball. While specific feature combinations are described in the following with respect to the exemplary embodiments, it is to be understood that the disclosure is not limited to such embodiments. In particular, not all features have to be present, and the embodiments may be modified by combining certain features of one embodiment with at least one feature of another embodiment.

Figure 1B:
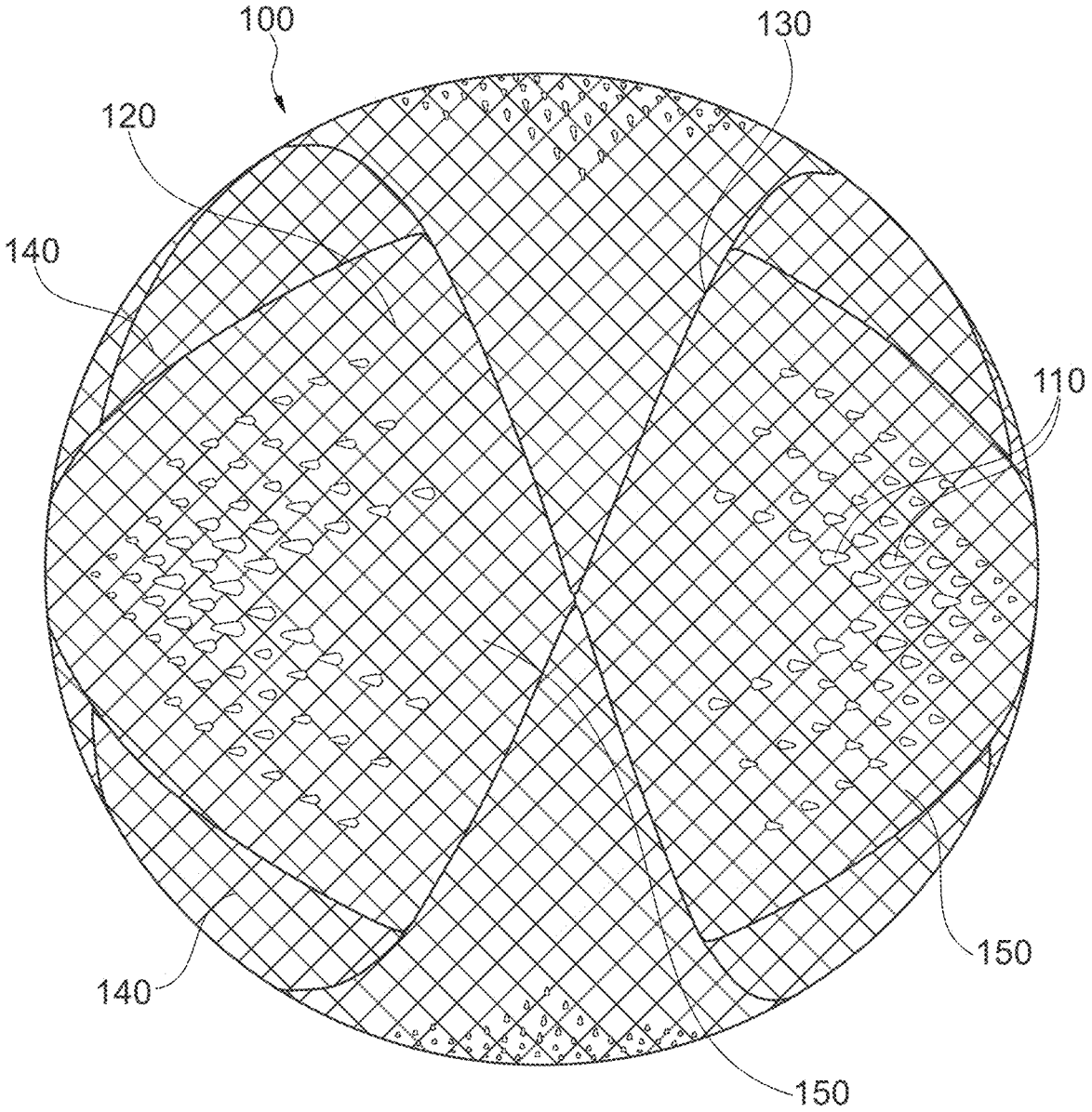
Figure 1C:
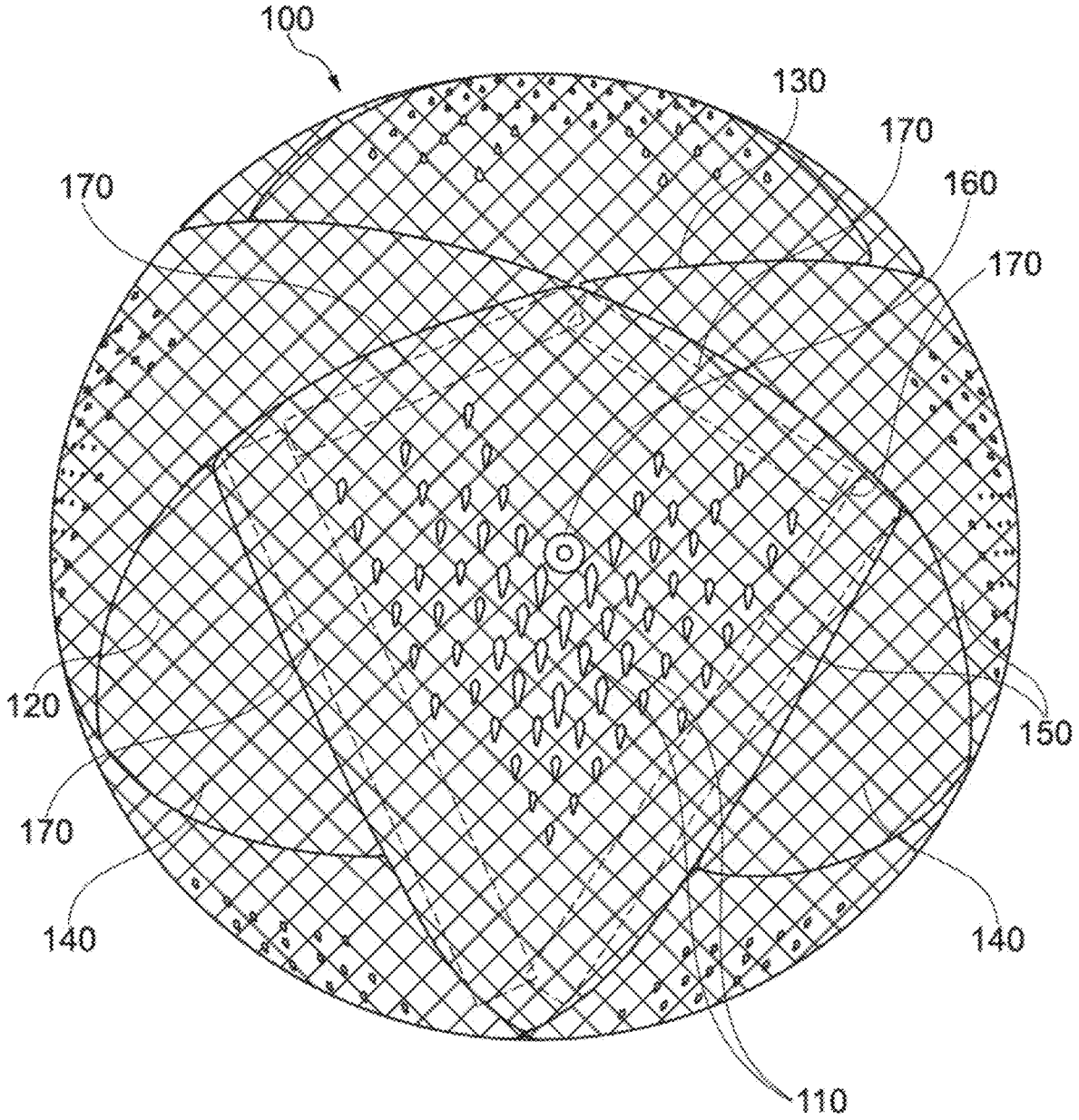

FIGS. 1*a* through 1*c* depict three different points of view of an inflatable ball 100 according to various embodiments. The ball 100 may be a soccer ball. While the features are mainly described relating to a soccer ball, anyone skilled in the field can easily apply these features to balls of various other sports, such as volleyball, handball, or others. The ball 100 has an outer shell comprising various panels 140, 150. The panels 140, 150 on the outer layer comprise a surface texture 120. The surface texture 120 represents a regular pattern uniformly distributed on each panel. It may be understood that panel edges 130 represent a disruption of the regular pattern. During assembly of the premanufactured panels 140, 150, panel edges 130 may be bonded together using a glue, via a thermo activated bonding, or by sewing or stitching. The shape of the surface texture 120 is essentially tetragonal having a longest side length of approximately 5 mm. The extent of the surface texture 120, which represents a maximum distance in a height profile of the surface texture 120, is less than 1 mm. While FIGS. 1*a* through 1*c* depict the ball 100 having one uniformly distributed surface texture 120, it may be noted that different surface textures on the same panel or on adjacent panels are also applicable.

A subset of panels 150 comprises, in addition to the surface texture 120, indentations 110. Panels 140 not within the subset of panels 150 are free of such indentations 110. As depicted in FIGS. 1*a* through 1*c*, the indentations 110 have a shape very similar to a kite. In general, the shape (mathematically) belongs to the group of polygons. While the indentations 110 are mainly distributed in a central region of the subset of panels 150, an edge region 170 close to the seams or edges 130 of the panels 150 has no indentations 110. Thus, compared to the regular surface texture 120, the indentations 110 are distributed in-homogeneously on each panel 150. The in-homogenous distribution of indentations can also be understood based on an average spacing between adjacent indentations. As depicted in FIGS. 1*a* through 1*c* and similarly in FIG. 3, an average spacing between adjacent indentations in a central region of the panel is smaller than in an edge or close-to-edge region. In this manner, a density of the indentations is varied across the panel. In some embodiments (not shown), a homogenous distribution of indentations is also feasible. This may be particularly beneficial for indentations having an elliptical shape (cf. indentations 211 of FIGS. 2*a* through 2*c*).

The inflatable ball 100 further comprises a bladder, which may be covered by a carcass (not shown). For inflating the ball 100 using, e.g., an air pump or a compressor, a sealable opening 160 connected to the inner bladder is guided through the carcass and the outer shell. During manufacture of the ball 100, the panels 140, 150 and the carcass are in some embodiments spray-coated with glue and, in a subsequent step, attached to each other. The glue can comprise latex.

The various features of the inflatable ball 100 described above, in particular the combination of indentations 110 and the surface texture 120, all play a part in contributing to a ball 100 with enhanced control and a more reliable flight behavior. In this manner, the surface texture 120 not only increases the control over the ball 100 at the shoe but also positively increases a potential range of a shot. Based on the small vertical extent and the essentially regular pattern of the surface texture 120, a thin, turbulent boundary layer of air that clings to the ball's surface is created, which reduces an amount of drag of the ball 100 compared to balls known in the art having a smooth outer surface. Additionally, while these known balls, in particular if made of less but larger panels, are prone to fluttering during long range shots, these effects are remarkably well suppressed by the inflatable ball 100. The indentations 110 of the panels 150 result in a more balanced magnus effect in the air leading to a controlled and stable degree of swerve, which may be understood as the main reason for reducing the fluttering of the inflatable ball 100. In this regard, the positioning of the indentations 110 on the panel 150, the polygonal shape of the indentations 110, a depth of the indentations 110, a distance of the indentations to each other, or a combination thereof, for example as depictable from FIGS. 1*a* through 1*c*, lead to a more stable and more reliably predictable trajectory of the ball 100.

The inventors found that for a ball having an overall roughness volume within the range of 7000 and 30000 $mm^3$, the critical Reynolds number of the ball when flying through air may be shifted towards lower velocities, at which the flight behavior of the ball essentially does not depend on its drag or at which the flight behavior of the ball depends significantly less on its drag. This may be based on an exponential relationship between aerodynamic forces and airspeed. As a result, at higher velocities at which the drag is relevant for the ball's flight behavior, an essentially constant drag across various velocities may be accomplished. In this manner, a prediction of a trajectory of the ball may be greatly improved. Additionally, unintended fluttering of the ball may be reduced. For example, when developing a new inflatable ball, a roughness volume of the seams may be determined first. Then, a plurality of indentations and/or at least one surface texture matching the suitable amount of roughness volume may be added to result at an overall roughness volume in the beneficially defined above ranges. The indentations and/or the at least one surface texture in some embodiments corresponds to the indentations and surface texture(s) as described herein.

Figure 2A:
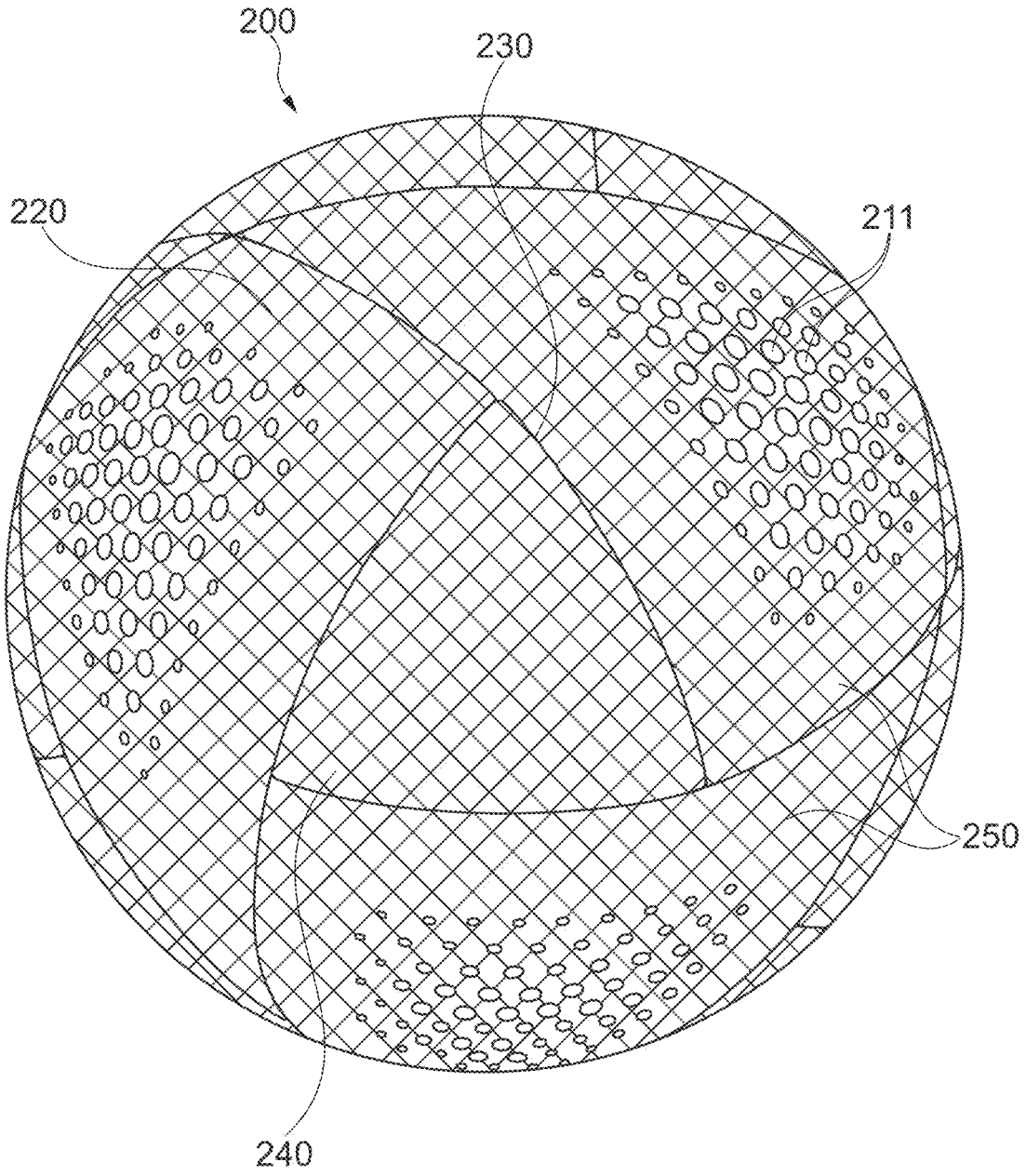
FIGS. 2*a*, 2*b*, and 2*c* show three different point of view of a ball with elliptically shaped indentations, in accordance with various embodiments.
Figure 2B:
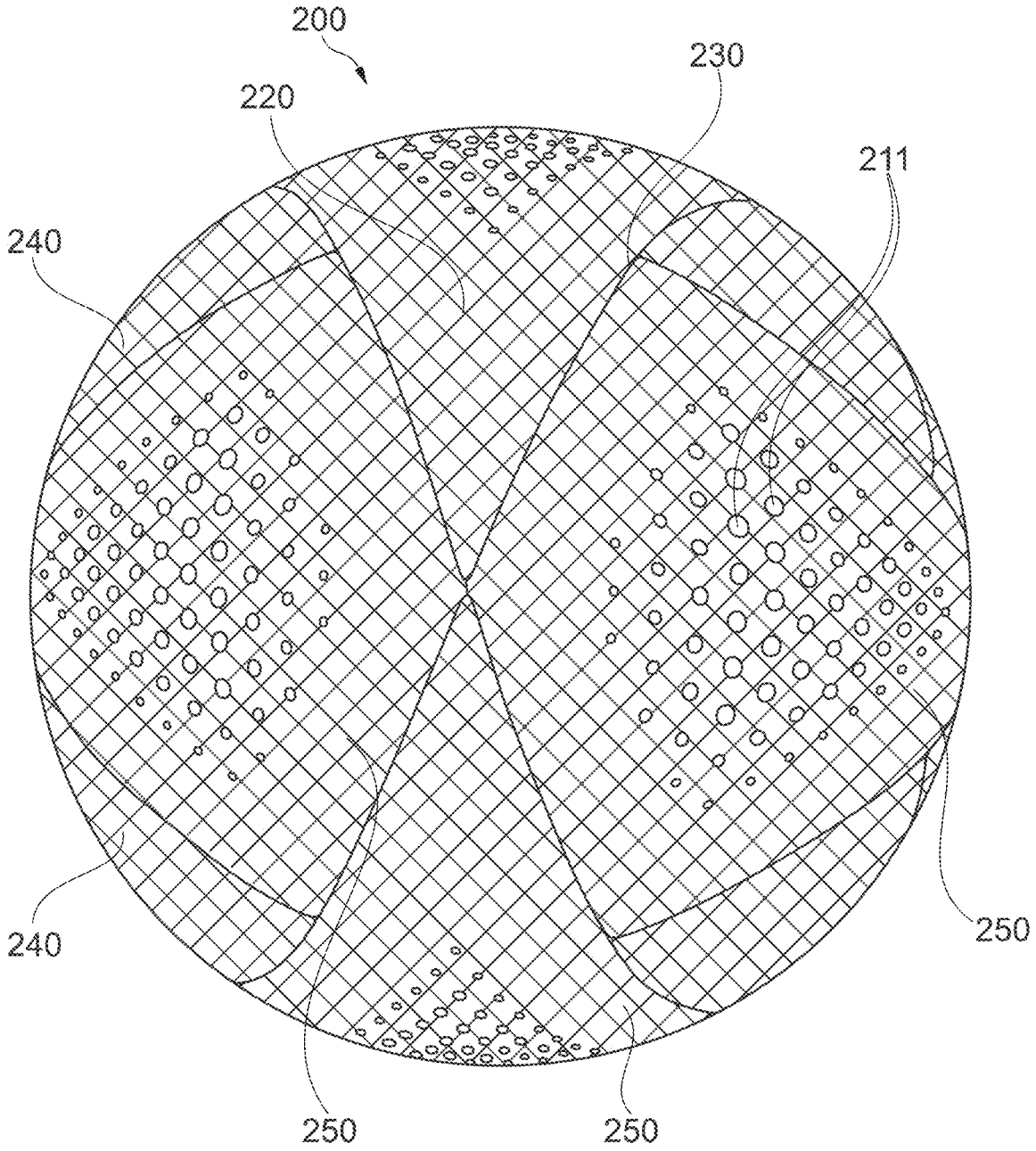
Figure 2C:
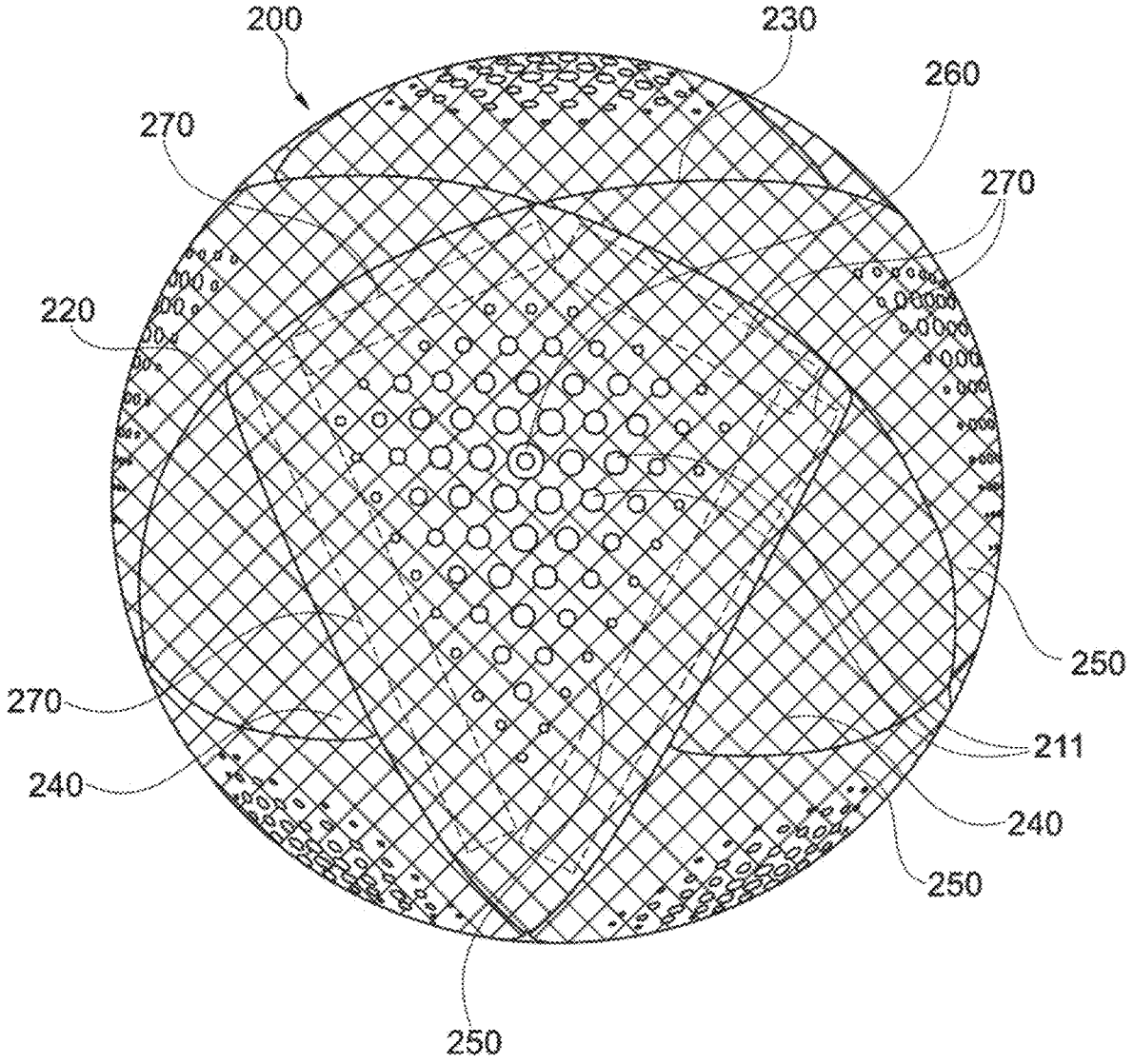

FIGS. 2*a* through 2*c* depict a ball 200 comprising an outer shell having panels 240, 250 connected at their edges 230. The panels 240 comprise a surface texture 220 and provide the same advantages mentioned regarding panels 140. The panels 250 comprise indentations 211 and provide very similar advantages as mentioned regarding panels 150. Compared to the panels 150, the panels 250 comprise essentially circular indentations 211, which depending on manufacturing uncertainties may be generally elliptical. The indentations 211 are mainly distributed in a central region of the panels 250, while an edge region 270 close to the seams or edges 230 of the panels 250 has no indentations 211. Thus, similar to the indentations 110 of ball 100, the indentations 211 of ball 200 are also distributed in-homogeneously on each panel 250. This may be also seen as a decrease of indentation density going from a central region to the edge region 270 of panels 250. As depicted for example in FIG. 2*a*, the surface texture 220 and the indentations 211 may be arranged independently from each other on the panels 250. Thus, a pattern of the surface texture 220 is not interrupted or significantly changed at the indentations 211. In this manner, the surface texture 220 may be present in the indentations 220 and vice versa, which is also applicable for the other embodiments described herein, e.g., the inflatable ball 100 comprising indentations 110 and the surface texture 120. The inflatable ball 200 further comprises a bladder, which may be covered by a carcass (not shown). For inflating the ball 200 using, e.g., an air pump or a compressor, a sealable opening 260 connected to the inner bladder is guided through the carcass and the outer shell. Like the ball 100, the flight behavior of ball 200 depends on the various parameters of the indentations 211 listed above regarding indentations 110.

Figure 3:
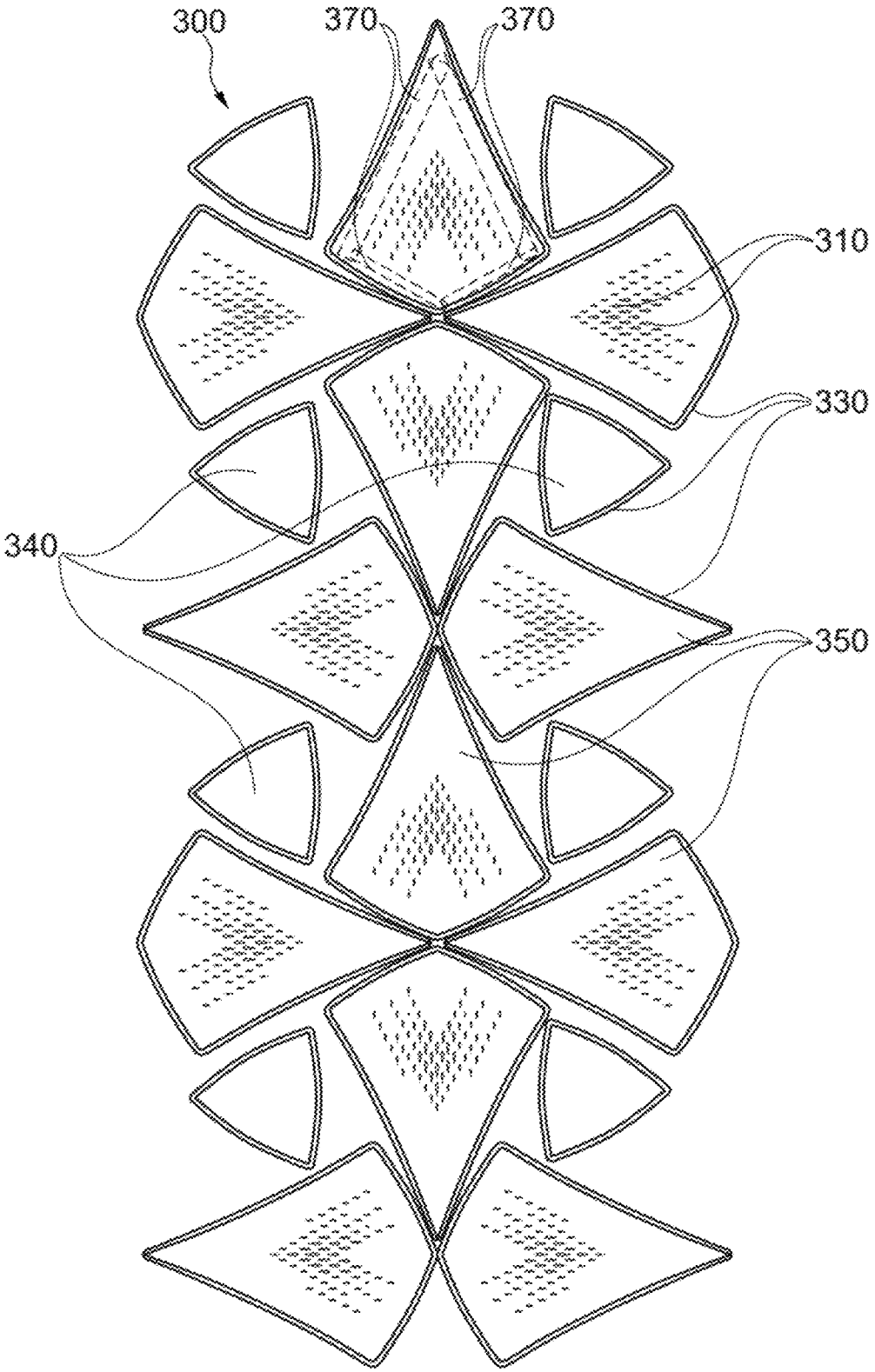
FIG. 3 illustrates a net showing a distribution of kite-shaped indentations, in accordance with various embodiments.

FIG. 3 schematically illustrates a panel configuration 300. Panel configuration 300 depicts a two-dimensional configuration of various panels 340, 350, similar to a net of a polyhedron. In geometry, a net of a polyhedron is a configuration of non-overlapping edge-joined polygons in the plane which may be folded (along edges) to become the faces of the polyhedron. In this manner, aligning neighboring panel edges 330 on a bladder or carcass like the folding step of the polygons and attaching the panels 340, 350 on the bladder or carcass results in an inflatable ball. The panel configuration 300 comprises twelve panels 350 having indentations 310. The indentations 310 are essentially arranged in a central region of the panels 350. By that, edge regions 370 are free of any indentations 310. In other words, a density of indentations 310 is highest in the central region of the panels 350 and decreases in a direction to the panel edges 330. The panel configuration 300 further comprises eight panels 340 without any indentation 310. In addition to the indentations 310 on a subset of panels 350, all panels 340, 350 of panel configuration 300 include a surface texture (not shown in FIG. 3). The beneficial synergetic effects provided by the combination of indentations 310 and the surface texture are discussed above with respect to FIG. 1 and are also applicable here.

Figure 4A:
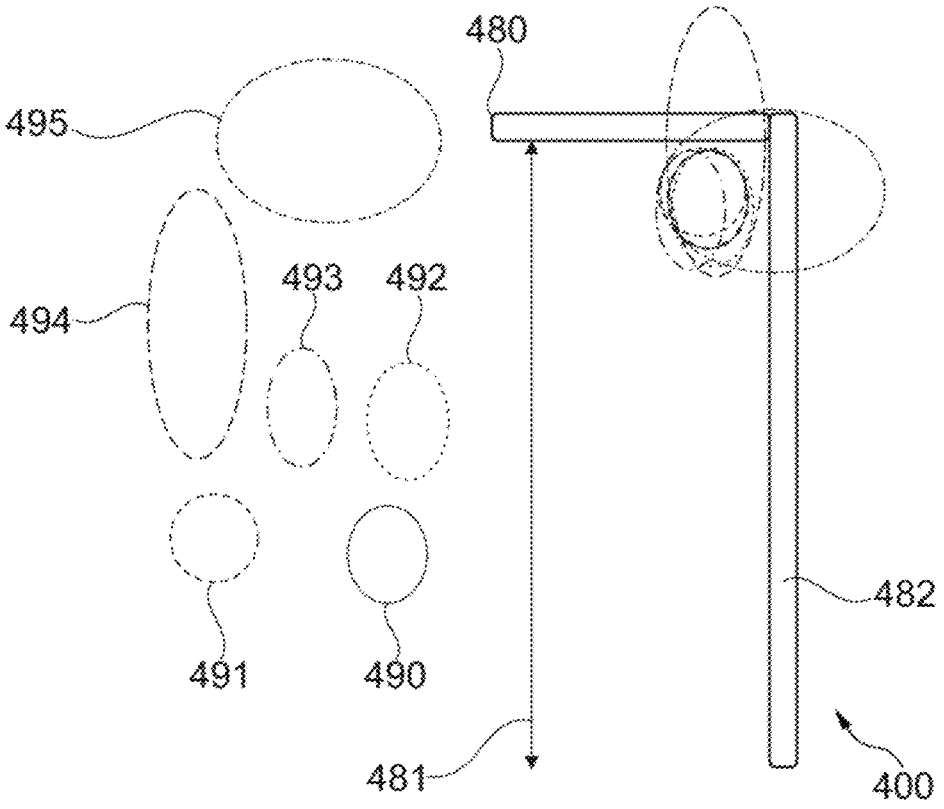
FIG. 4*a* illustrates an example of true-to-scale impact zones of some embodiments compared with other balls.

FIG. 4*a* depicts a partial view on an experimental setup of a goal 400 illustrating true to scale impact zones 490-495 of various balls. Goal 400 includes a bar 480 and a post 482 creating a 90°-corner at their juncture. A height 281 of the goal 400 is 2.44 m, which is in accordance with standard FIFA™ regulations. The inventors conducted various experiments under lab conditions comparing balls known in the art with inflatable balls according to the present disclosure. In a first experiment, a swerve kick was performed using a typical soccer shoe attached to an experimental setup, which resembles a player's leg movement while kicking a ball. A speed of the shoe was set to 20 m/s, which approximately resulted in a ball speed of around 90 km/h (i.e., 25 m/s). Kicks with each ball have been repeated eighteen times using six different contact points of the shoe on each ball. Contact points varied between, for example, a center of a panel, an edge/seam of a panel, an edge/seam point of more than two panels etc. The trajectory of each ball has been determined by video analysis. An air pressure of each ball was set to 0.8 bar.

FIG. 4*a* illustrates various elliptically shaped impact zones 490-495 arranged in the juncture of post 482 and bar 480 arising from the above-mentioned video analysis. The impact zones 490-495 correspond to true-to-scale impact zones of the various tested balls. For improved visualization of the various zones, each impact zone 490-495 has been illustrated on the left side of FIG. 4*a* without overlapping with other impact zones but still true-to-scale. Impact zones 490 and 491 correspond to an inflatable ball in which all panels comprise a surface texture and a subset thereof additionally comprises indentations. The indentations of the inflatable ball corresponding to impact zone 490 are kite-shaped while the respective indentations corresponding to impact zone 491 are circular. Impact zone 492-495 correspond to balls known in the art. It may be depicted that the polygonal shaped indentations provide a higher level of predictability. On the other hand, the inventors found in a second experiment (not shown) that elliptically shaped indentations enable a slightly higher speed of a ball for straight kicks.

Figure 4B:
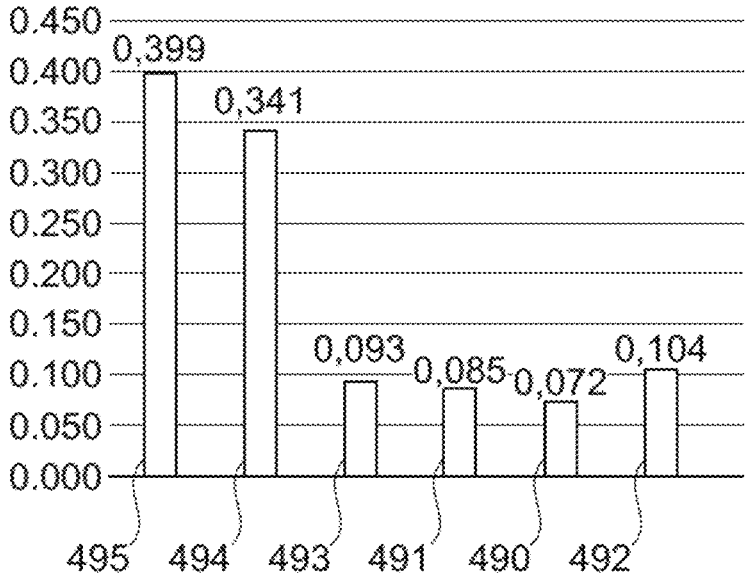
FIG. 4*b* is a diagram illustrating impact zones of some embodiments compared with other balls.

FIG. 4*b* illustrates a size of each impact zone 490-495 in a diagram. Additionally, for each ball, the size in units of square meters is indicated on top of each bar in the diagram. As may be seen, the embodiments according to the present disclosure exhibit the smallest sizes of impact zones 490, 491. It may be noted that a small impact zone equally means a highly reliable flight behavior, in particular relating to a predictability of the flight behavior. A small impact zone further implies a strong reduction of a fluttering effect known from many balls of the prior art.

Figure 5A:
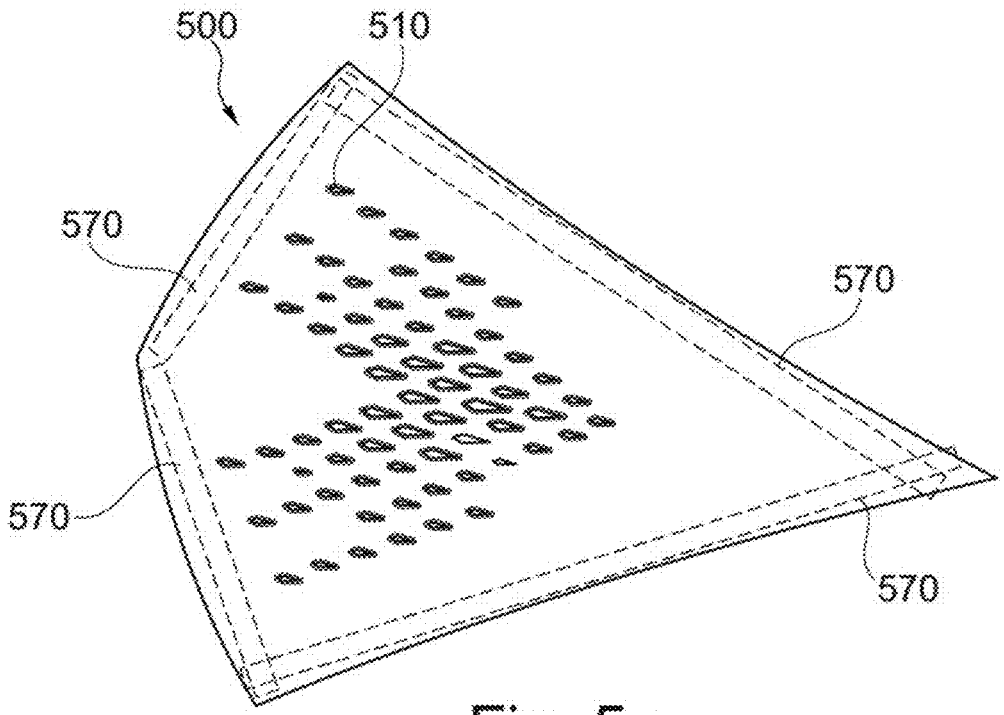
FIGS. 5*a* and 5*b* show differing points of view of an example of a press plate having kite-shaped protrusions, in accordance with various embodiments.
Figure 5B:
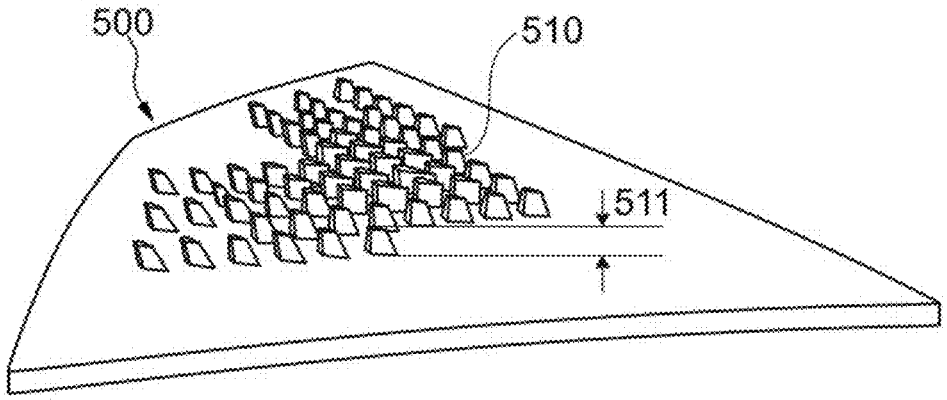

FIGS. 5*a* and 5*b* illustrate a press plate 500 from two points of view. A manufacturing/creation process of the indentations may be as follows: A pre-manufactured panel is placed on a platen. Then a press plate with protrusions 510, e.g. press plate 500, is moved in direction to the panel to sandwich the panel between the platen and the press plate 500. By that, the protrusions 510 of the press plate 500 will be pressed into the outer surface of the panel, resulting in indentations. Press plate 500 exhibits kite-shaped protrusions 510, which lead to essentially kite-shaped indentations on a panel. The protrusions 510 are in-homogenously arranged on press plate 500. Thereby, based on press plate edges 570 exhibiting no protrusions 510, a corresponding panel will accordingly also exhibit no indentations in an edge region of the panel. A height 511 of the protrusions 510 is approximately 5 mm, resulting in indentations of equal to or less than 5 mm. It may be noted that other shapes, particularly elliptical shapes, other sizes, other distributions, particularly homogenous distributions, or a combination therefrom is also applicable for press plates.

Figure 6:
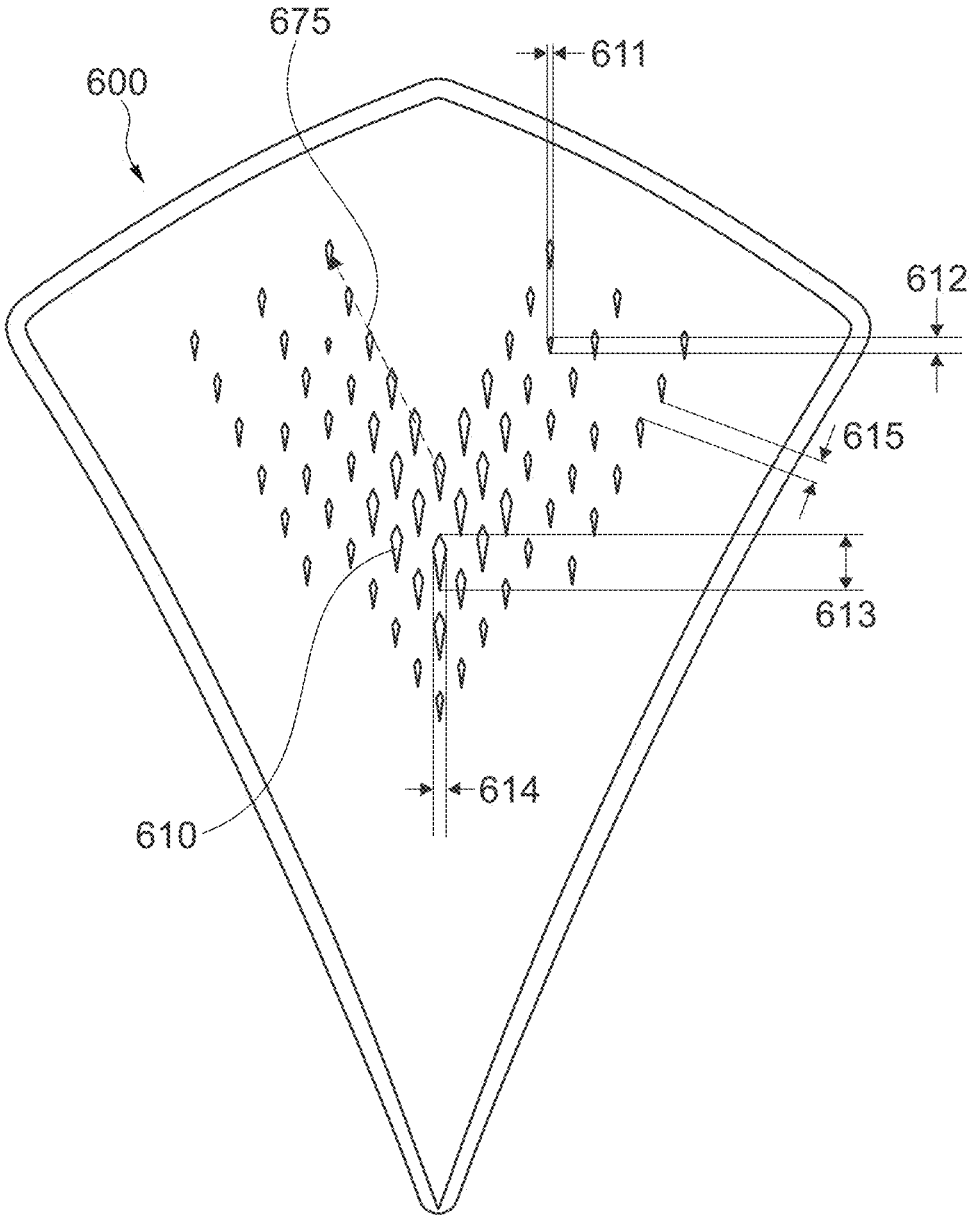
FIG. 6 show an example of a panel having kite-shaped indentations, in accordance with various embodiments.

FIG. 6 illustrates a panel 600. For example, panel 600 may be manufactured using press plate 500. Panel 600 can comprise an outer layer, in some embodiments comprising a polyurethane, and an inner layer comprising a foamed material. The inner layer in some embodiments comprises an ethylene propylene diene monomer (not shown). Panel 600 comprises kite-shaped indentations 610 which are in-homogenously arranged, wherein a shortest distance 615 of indentations 610 ranges between 1.5 mm and 15.0 mm. The indentations 610 may at least extend into the inner foam layer. On the contrary, the extent of the surface texture (not shown) may be limited to the outer layer only. In this manner, a maximum extent of the surface texture perpendicular to a surface of the inflatable ball may be smaller than a maximum depth of the indentations. As depicted in FIG. 6, a size of the indentations 610 decreases from an inner or central region in direction 675 to an outer or edge region. In general, an indentation depth, an indentation length 612, 613, an indentation width 611, 614 or a combination thereof can vary on a single panel. In FIG. 6, an inner or largest indentation has a length 613 of 9.2 mm and a width 614 of 2.2 mm. An outer or smallest indentation has a length 612 of 2.3 mm and a width 611 of 0.5 mm.

It may be noted, while the described embodiments above and the figures mainly depict a single surface texture, more than one surface texture on adjacent panels or even on the same panel are also applicable. Moreover, embodiments comprising a combination of various shapes of indentations on different panels or even the same panel of an inflatable ball are also possible. For example, the different shapes may be grouped relative to each other building a formation. A plurality of formations may be distributed at least partly across the panel(s), such that a distribution of the different shapes may be repeatedly the same within the plurality of formations.

In the following, further examples are described to facilitate the understanding of the invention:

Example 1. Inflatable ball (100, 200), in particular soccer ball, having an outer shell comprising panels (140, 150, 240, 250, 340, 350, 600), wherein:

the panels (140, 150, 240, 250, 340, 350, 600) comprise at least one surface texture (120, 220), wherein at least a subset of the panels (150, 250, 350, 600) comprises indentations (110, 211, 310, 610) in addition to the surface texture (120, 220), and wherein the indentations (110, 211, 310, 610) comprise a shape which is different from a shape of the surface texture (120, 220).

Example 2. Inflatable ball according to example 1, wherein only the subset of the panels comprises indentations in addition to the surface texture.

Example 3. Inflatable ball according to example 1, wherein all panels comprise indentations in addition to the surface texture.

Example 4. Inflatable ball according to one of the previous examples, wherein the indentations are polygonal, in particular essentially kite-shaped, and/or elliptical, in particular essentially circular.

Example 5. Inflatable ball according to one of the previous examples, wherein the indentations are not in contact to panel edges (130, 230, 330) and/or essentially placed within a central region of a panel.

Example 6. Inflatable ball according to one of the previous examples, wherein the indentations are distributed inhomogeneously on each panel having indentations.

Example 7. Inflatable ball according to one of the examples 1 to 5, wherein the indentations are distributed homogeneously on each panel having indentations.

Example 8. Inflatable ball according to one of the previous examples, wherein each panel comprises only one surface texture.

Example 9. Inflatable ball according to the previous example, wherein the surface texture is essentially uniformly distributed on each of the panels.

Example 10. Inflatable ball according to one of the previous examples, wherein a shape of the surface texture is the same on each panel.

Example 11. Inflatable ball according to one of the examples 1 to 7, wherein at least some panels comprise more than one surface texture.

Example 12. Inflatable ball according to one of the previous examples, wherein a maximum extent of the at least one surface texture perpendicular to a surface of the inflatable ball is smaller than a maximum depth of the indentations.

Example 13. Inflatable ball according to one of the previous examples, wherein each panel having indentations comprises at least two, preferably at least three and more preferably at least four distinct indentation depths, indentation lengths (612, 613), indentation widths (611, 614) or a combination thereof.

Example 14. Inflatable ball according to one of the previous examples, wherein on each panel having indentations an indentation depth, indentation length, indentation width or a combination thereof decreases on average in a direction (675) from an inner region to an outer/edge region (170, 370, 570) of the panel.

Example 15. Inflatable ball according to one of the previous examples, wherein an indentation length (612, 613) varies between 1.0 and 30.0 mm, preferably between 1.5 and 20.0 mm and more preferably between 2.0 and 10.0 mm.

Example 16. Inflatable ball according to one of the previous examples, wherein an indentation depth varies between 0 and 10 mm, preferably between 0 and 8 mm and more preferably between 0 and 6 mm.

Example 17. Inflatable ball according to one of the previous examples, wherein an indentation width (611, 614) varies between 0.1 and 15.0 mm, preferably between 0.2 and 7.5 mm and more preferably between 0.4 and 2.5 mm.

Example 18. Inflatable ball according to one of the previous examples, wherein a flight behavior, in particular a predictability of the flight behavior, of the inflatable ball depends on one of: a position of the indentations on the panel, a shape of the indentations, a depth of the indentations, a distance of the indentations to each other, or a combination thereof.

Example 19. Inflatable ball according to one of the previous examples, wherein a shortest distance (615) between two neighboring indentations on the same panel is between 0.5 and 45.0 mm, preferably between 1.0 and 30.0 mm and most preferably between 1.5 and 15.0 mm.

Example 20. Inflatable ball according to one of the previous examples, wherein each panel comprises an outer layer comprising polyurethane, PU.

Example 21. Inflatable ball according to one of the previous examples, wherein each panel comprises an inner layer comprising a foamed material, preferably ethylene propylene diene monomer, EPDM.

Example 22. Inflatable ball according to one of the examples 20 and 21, wherein at least some indentations extend partly into a top surface of the inner layer.

Example 23. Inflatable ball according to one of the examples 20 to 22, wherein the at least one surface texture extends only in the outer layer.

Example 24. Inflatable ball according to one of the previous examples, further comprising a carcass.

Example 25. Inflatable ball according to the previous example, wherein the panels and the carcass are at least partly spray-coated with a glue, preferably comprising latex.

Example 26. Inflatable ball according to one of the previous examples, wherein panel edges of neighboring panels are connected to each other via thermo activated bonding.

Example 27. Inflatable ball according to one of the previous examples, wherein the indentations are applied after a panel forming process.

Example 28. Inflatable all according to one of the previous examples, wherein the indentations are created by pressing a plate (500) having protrusions (510) onto at least one panel.

Example 29. Inflatable ball according to one of the previous examples, wherein the subset comprises less than 32 panels, preferably less than 24 panels and most preferably 12 panels.

Example 30. Inflatable ball according to one of the previous examples, wherein the number of panels not within the subset is less than 24 panels, preferably less than 16 panels and most preferably 8.

Example 31. Inflatable ball according to one of the previous examples, wherein a maximum extent of the at least one surface texture perpendicular to a surface of the inflatable ball is less than 1.5 mm, preferably less than 1.0 mm and more preferably less than 0.5 mm.

Example 32. Inflatable ball according to one of the previous examples, wherein a shape of at least one surface texture is polygonal, preferably tetragonal.

Example 33. Inflatable ball according to the previous example, wherein a maximum length of a side of the polygonal surface texture is less than 20 mm, preferably less than 15 mm more preferably less than 10 mm.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An inflatable ball, comprising:

an outer shell defining an outer ball surface and comprising panels, wherein:

the panels comprise at least one surface texture;

at least a subset of the panels comprises indentations in addition to the surface texture;

the indentations comprise an indentation depth extending inwardly relative to the outer ball surface and an indentation shape with indentation length and indentation width extending along the outer ball surface;

the indentation shape is different from a texture shape of the surface texture;

the indentation shape is essentially kite-shaped, essentially elliptical, or essentially circular; and a maximum extent of the at least one surface texture perpendicular to the outer ball surface of the inflatable ball is smaller than a maximum depth of the indentations.

2. The inflatable ball of claim 1, wherein the inflatable ball comprises a soccer ball.

3. The inflatable ball of claim 1, wherein only the subset of the panels comprises the indentations in addition to the surface texture, or wherein all of the panels comprise the indentations in addition to the surface texture.

4. The inflatable ball of claim 1, wherein at least one of:

the indentations are not in contact with panel edges; or the indentations are essentially placed within a central region of a panel.

5. The inflatable ball of claim 1, wherein the indentations are distributed in-homogeneously on each panel having indentations, or wherein the indentations are distributed homogeneously on each panel having indentations.

6. The inflatable ball of claim 1, wherein each panel comprises only one surface texture.

7. The inflatable ball of claim 6, the surface texture is essentially uniformly distributed on each of the panels, and/or wherein a shape of the surface texture is the same on each panel.

8. The inflatable ball of claim 1, wherein at least some panels comprise more than one surface texture.

9. The inflatable ball of claim 1, wherein the surface texture comprises multiple different shapes which are grouped relative to each other in a formation, wherein a plurality of formations is distributed at least partly across the panels, such that a distribution of the different shapes is repeatedly the same within the plurality of formations.

10. The inflatable ball of claim 1, wherein each panel having indentations comprises at least two distinct indentation depths, indentation lengths, indentation widths, or a combination thereof, and/or wherein on each panel having indentations the indentation depth, indentation length, indentation width, or a combination thereof decreases on average in a direction from an inner region to an outer/edge region of the panel.

11. The inflatable ball of claim 1, wherein at least one of:

the indentation length varies between 1.0 and 30.0 mm;

the indentation depth varies between 0 and 10 mm; or the indentation width varies between 0.1 and 15.0 mm.

12. The inflatable ball of claim 1, wherein each panel comprises an outer layer comprising polyurethane, and/or wherein each panel comprises an inner layer comprising a foamed material.

13. The inflatable ball of claim 12, wherein at least some indentations extend partly into a top surface of the inner layer and/or wherein the at least one surface texture extends only in the outer layer.

14. The inflatable ball of claim 1, wherein the subset comprises less than 32 panels, and/or wherein the number of panels not within the subset is less than 24 panels.

15. The inflatable ball of claim 1, wherein a maximum extent of the at least one surface texture perpendicular to the outer ball surface of the inflatable ball is less than 1.5 mm, and/or wherein a maximum length of a side of the at least one surface texture is less than 20 mm.

16. The inflatable ball of claim 1, wherein an overall roughness volume of the outer ball surface of the inflatable ball ranges between 7000 and 30000 $mm^3$.

17. An inflatable ball, comprising:

an outer shell defining an outer ball surface and comprising panels, wherein:

the panels comprise at least one surface texture;

at least a subset of the panels comprises indentations in addition to the surface texture;

the indentations comprise an indentation depth extending inwardly relative to the outer ball surface and an indentation shape with indentation length and indentation width extending along the outer ball surface;

the indentation shape is different from a texture shape of the surface texture;

the indentation shape is essentially kite-shaped, essentially elliptical, or essentially circular; and at least one of:

the indentation length varies between 1.0 and 30.0 mm;

the indentation depth varies between 0 and 10 mm; or the indentation width varies between 0.1 and 15.0 mm.

* * * * *